US006955756B2

(12) United States Patent
Fallon

(10) Patent No.: US 6,955,756 B2
(45) Date of Patent: Oct. 18, 2005

(54) STORM DRAIN MOVABLE BAFFLE

(75) Inventor: Timothy Q. Fallon, Geneva, IL (US)

(73) Assignee: Mueller Group, Inc., Smithfield, RI (US)

( * ) Notice: Subject to any disclaimer, the term of this patent is extended or adjusted under 35 U.S.C. 154(b) by 27 days.

(21) Appl. No.: 10/624,951

(22) Filed: Jul. 21, 2003

(65) Prior Publication Data

US 2005/0035038 A1 Feb. 17, 2005

Related U.S. Application Data

(60) Provisional application No. 60/396,732, filed on Jul. 19, 2002.

(51) Int. Cl.[7] ..... E03F 5/14

(52) U.S. Cl. ..... 210/131; 210/156; 210/170; 210/532.1

(58) Field of Search ..... 210/131, 153, 210/156, 162, 170, 521, 532.1

(56) References Cited

U.S. PATENT DOCUMENTS

| | | | | |
|---|---|---|---|---|
| 999,305 | A * | 8/1911 | Gurnett | 210/131 |
| 1,248,374 | A * | 11/1917 | Moore | 210/521 |
| 1,265,251 | A * | 5/1918 | Rush | 210/156 |
| 1,302,839 | A * | 5/1919 | Olson | 210/156 |
| 1,666,756 | A * | 4/1928 | Sass | 210/153 |
| 4,046,161 | A * | 9/1977 | Bonneau | 210/131 |
| 5,503,753 | A * | 4/1996 | Woodall et al. | 210/532.1 |
| 5,700,378 | A * | 12/1997 | Lee et al. | 210/521 |
| 6,015,489 | A * | 1/2000 | Allen et al. | 210/131 |
| 6,183,633 | B1 * | 2/2001 | Phillips | 210/156 |
| 6,217,756 | B1 * | 4/2001 | Martinez | 210/131 |
| 6,478,954 | B1 * | 11/2002 | Turner et al. | 210/170 |
| 6,767,456 | B2 * | 7/2004 | Middleton et al. | 210/156 |
| 6,797,161 | B2 * | 9/2004 | Use et al. | 210/521 |

OTHER PUBLICATIONS

Webster's Collegiate Dictionary, p. 86, definition of "Baffle," 1999.*

* cited by examiner

*Primary Examiner*—Christopher Upton
(74) *Attorney, Agent, or Firm*—Troutman Sanders LLP; Gerald R. Boss, Esq.; James Hunt Yancey, Jr., Esq.

(57) ABSTRACT

A flow control baffle is suspended from a pivot shaft across a drain passage to restrict passage of waste material; the shaft is connected to a torque limiter which prevents rotation until a selected load is applied to the baffle upstream face; the torque limiter has a number of detent balls that are forced into detents by a series of springs acting thru a spring seat; increased flow increases torque on the baffle with the increasing torque transmitted through the baffle shaft and to the torque limiter. When the liquid reaches a preset level, the balls are forced out of the detents against the force of the springs and the baffle is free to rotate and float on the liquid surface. As the liquid level recedes, the baffle will return to its original vertical position, the balls will re-engage in the detents and lock the baffle in its original position and ready for the next cycle.

9 Claims, 4 Drawing Sheets

STORM DRAIN MOVABLE BAFFLE

CROSS-REFERENCE TO RELATED APPLICATIONS

This application claims the benefit of provisional application No. 60/396,732 filed on Jul. 19, 2002.

FIELD OF THE INVENTION

The present invention relates to storm or drainage flow controls particularly where the flow is likely to include solids that must be segregated at least temporarily to permit downstream fluid handling operations to be carried out efficiently and safely.

BACKGROUND OF THE INVENTION

In many sewer and storm water drainage systems, modular parts of the system are constructed off site, transported and installed in a prepared site. Such preparation usually consists of excavation of an area to allow a contractor to quickly install and connect the prefabricated elements of the system. Such prefabrication reduces the costs of the system in terms of the portions used and the cost of installation. However, the design of the system cannot be easily modified due to the size of the prefabricated portions and the necessity to establish safe flow conditions to prevent wastewater overflow and local flooding. One particular difficulty in municipal drainage systems is accommodating short term increased flow due to storms of infrequent but large magnitude in terms of rainfall over a short interval. These are particularly difficult to manage where solid waste material must be impeded that is often included in the flow through the system. The problem becomes critical in storm events where the waste treatment facility is unable to handle the overflow and diversion of the flow is effected to prevent backup flooding. A particular problem exists with respect to handling floating debris and waste material in such systems. Under normal flow conditions, the waste water will be fed to a treatment plant. During or after a heavy rainfall, or in winter time, a rapid melt of snow and ice, water flow will increase and, in most systems, the overflow is diverted to rivers or lakes along with the contaminating waste.

SUMMARY OF THE INVENTION

The present invention provides an economically efficient solution to this problem by providing a baffle that operates substantially in two positions in a drain passage and after shifting from a low flow position to a high flow position, the baffle will automatically return to the low flow position when the flow volume changes. In the low flow position, the baffle extends in a plane that is substantially perpendicular to the direction of flow through the drain passage and is maintained in this position by a torque limit mounting while, in the high flow position, the baffle moves under the action of the flow and is released at a preset load by the torque limit mounting to move out of the way of the flow. When the flow drops, the baffle will return to its original position, that is, vertically extending across the flow. In the low flow position, the baffle acts to impede floating waste material and debris from flowing to the treatment facility. The strength of the torque limit mounting will determine the magnitude of the load caused by an increased flow at which the baffle will pivot to move out of the flow path and allow the flow to pass such as to a diversion channel and out of the drainage system. This function will prevent damage to the baffle and baffle mounting device while preventing a large amount of unwanted debris from reaching the water treatment facility.

BRIEF DESCRIPTION OF THE DRAWINGS

The foregoing and other objects of the present invention will become apparent from the following description taken in conjunction with the accompanying drawings, in which.

DETAILED DESCRIPTION OF THE INVENTION

Figure 1:
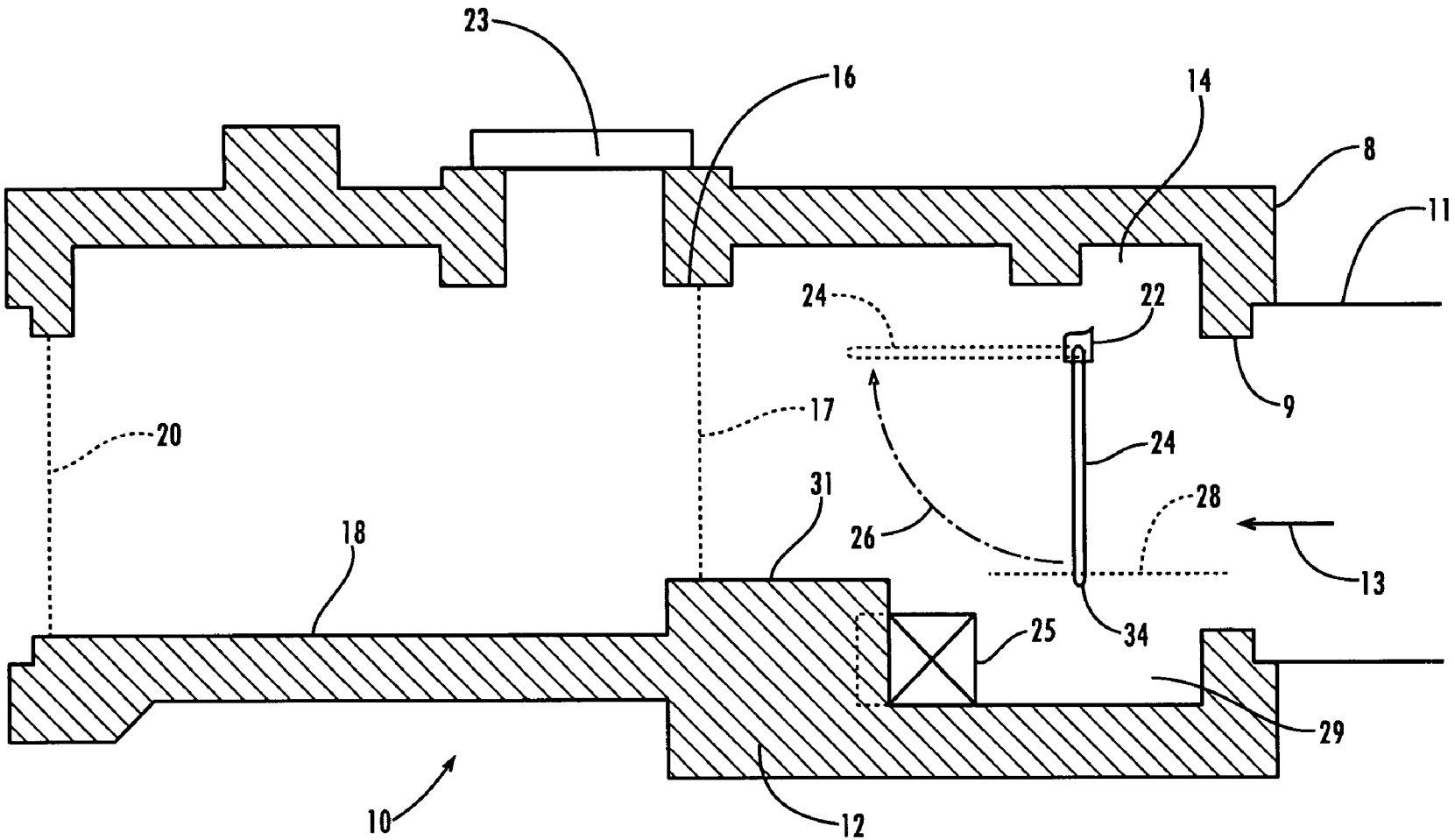
FIG. 1 is a side view in elevation of the drainage system of the present invention.
Figure 2:
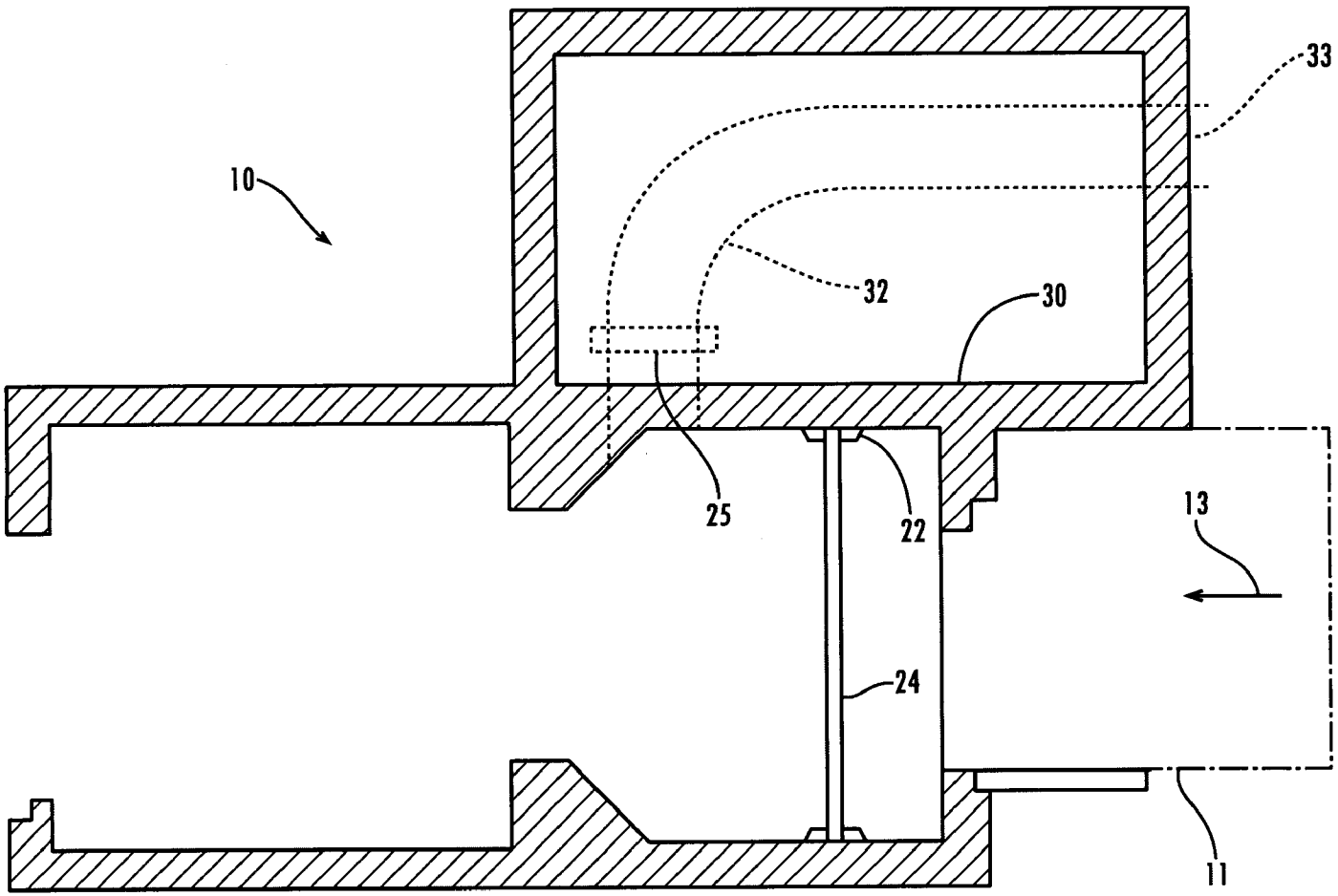
FIG. 2 to a top view along lines 2—2 of FIG. 1.
Figure 4:
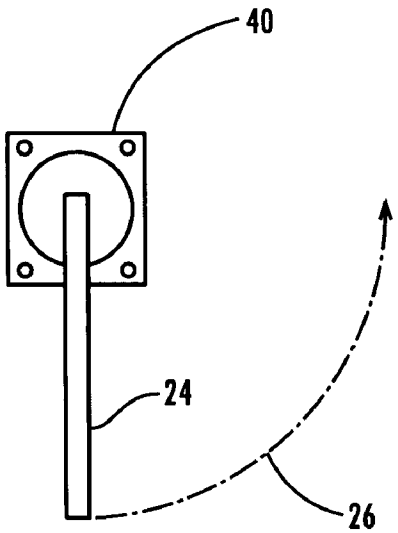
FIG. 4 is a side view along lines 4—4 of FIG. 3.

Referring to the drawings, wherein the like numerals designate corresponding parts throughout the several views, there is shown in FIGS. 1 and 2, a drainage installation 10 which is typically of concrete reinforced by steel rods or bars as is conventional. The installation 10 will have at its inlet an opening 9 to which will be connected to a drainage pipe 11. The opening 9 leads to a diversion chamber 14 in which is installed a baffle 24 and pivot mounts, one of which is shown at 22. As explained below, the pivot mounts, two of which are provided on opposite ends of a baffle support rod, allows the baffle 24 to pivot in the direction arrow 26 once a sufficient load is applied to the right hand face of the baffle 24 as viewed in FIG. 1. The diversion chamber 14 extends to the restriction 16 formed on the interior wall of the installation 10. Beyond the restriction 16, a tide gate chamber will be provided at 18. Normally, a weir 17 is placed across the restriction 16 to control the flow of liquid into the chamber 18. A diversion outlet 25 is provided opposite the inlet 9 and this typically will be used to direct fluid flow to a treatment facility.

Under normal weather conditions, liquid refuse and sewage will flow in the direction of arrow 13 through the inlet 9 and fill the well or recess 29 up to a nominal liquid level 28. The wall 31 has a height above the base of the well 29 based on the estimates of the range of flow volumes expected for an installation. The capacity of the installation 10 is selected based on the expected flow. Under normal or expected conditions, only periodic and relatively infrequent cleaning of the weir 17 will be required by workmen who will gain access to the weir 17 through a manhole cover 23. To control the accumulation of debris on the weir 17 and downstream of the weir 17, the baffle 24 is installed in the chamber 14 with the faces of the baffle 24 extending in a plane that is generally perpendicular to the flow direction 13. The bottom edge 34 of the baffle 24 should extend to the flow level 28 so that the baffle 24 will normally block floating debris from passing downstream in the liquid flow.

Figure 3:
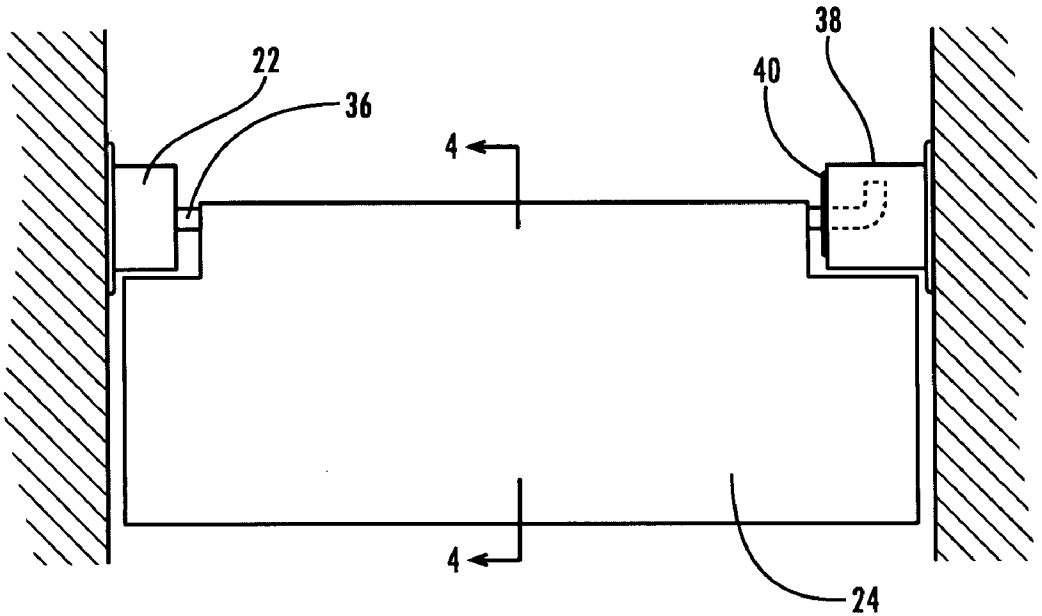
FIG. 3 is front view in elevation of the baffle and mounting used in the system.
Figure 5:
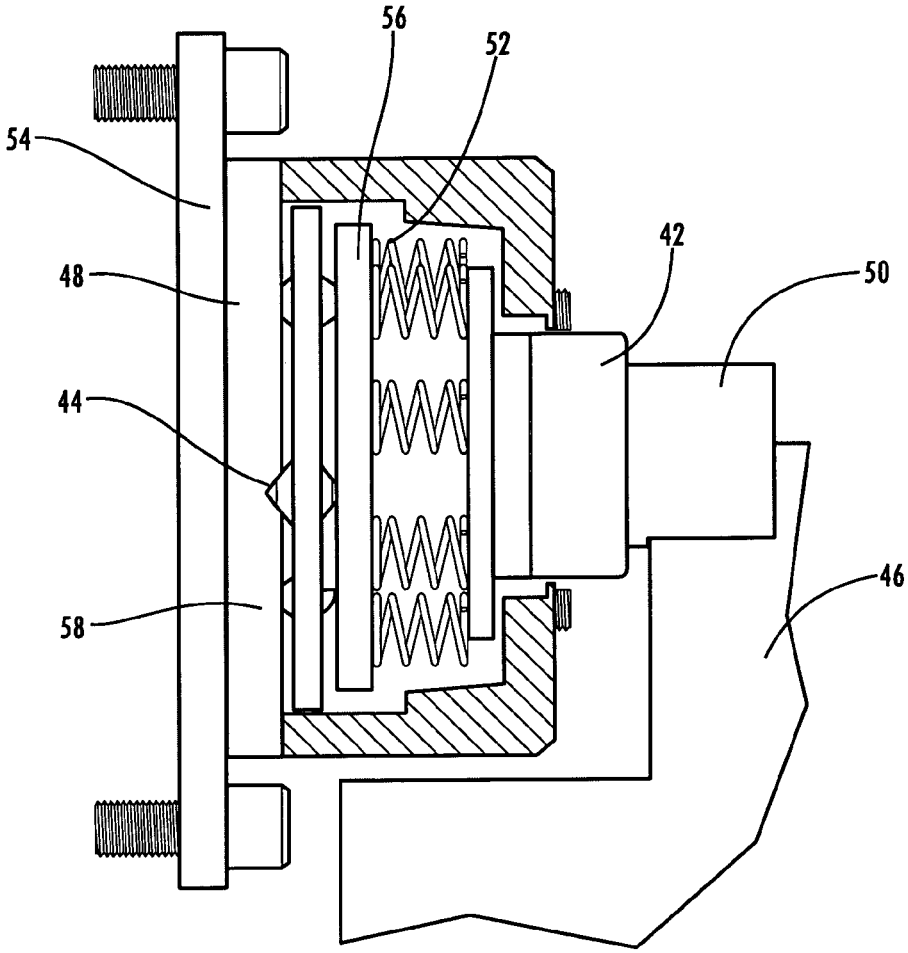
FIG. 5 is a side view of the torque limiter, useful in the present invention.

According to me present invention, to lessen or prevent damage to the baffle 24, a torque limiting mounting for the baffle 24 is provided. As shown in FIG. 3, the baffle 24 extends from a pivot rod 36, one end of which is mounted in a bearing support 22 while the opposite end 38 is mounted in a torque limiting device 40 such as one which is available from AUNSPACH CONTROLS CO, INC located in St. Louis, Mo., as schematically shown in FIG. 5 at 40. The maximum flow encountered upon the baffle right before it swings up and out of the way is 38,200 GPM. The weight of the baffle is effective to lower a tripped baffle. The baffle can swing freely anywhere between 2 and 88 degrees after it is tripped. The torque-limiting device 40 operates to maintain the baffle 24 in a vertical position as shown in FIG. 1. In the event the volume of the liquid flow entering through conduit 11 becomes elevated due, for example, to a rapid snow melt or heavy rainfall, the load on the right hand face of the baffle 24 will increase up to a preset limit which, when reached, will a result in unlocking of the baffle by the torque limiting device 40 to allow the baffle to move toward a horizontal position about the axis of the rod 36. According to the present invention, the material from which the baffle 24 is made may be less than the density of water. This will facilitate the pivoting movement of the baffle 24 to its horizontal position. When the liquid level has returned to its normal low flow condition, the baffle 24 will return to its vertical position under the influence of gravity. Under the high flow conditions, a sluice gate valve will be opened to allow flow through the diversion outlet 25 to prevent flooding of the downstream treatment facility. The diverted flow will pass through the diversion channel 32 to an outlet 33.

Any torque limiter may, of course, be employed. The model D82-6000 available from Aunspach Control Co. Inc. is particularly useful as it is designed to allow rotation of a shaft carrying the baffle as liquid flow reaches a predetermined load on the baffle face.

The model D82-6000 mechanism includes a number of alloy steel balls 48 that are forced into detents 44 by a series of springs 50 acting thru a spring seat 56.

In operation, the torque applied by the rising liquid to the baffle 46 flows from the baffle shaft 50 into the Model D82-6000 body 42 through the steel balls 48, then to the detent plate 58 and anchor plate 54 to the channel wall.

As rising liquid level increases torque on the baffle 46, the increasing torque flows thru the baffle shaft 50 and into the Model D82-6000 body 42. When the liquid reaches a preset level, the balls 48 are forced out of the detents 44 against the force of the springs 52. Once the balls 48 are out of the detents 44 the mechanism is disengaged and the baffle 46 is free to rotate and float on the liquid surface. As the liquid level recedes, the baffle 46 will return to its original vertical position, the balls 48 will re-engage in the detents 44 and lock the baffle 46 in its original position and ready for the next cycle.

The 100% stainless steel series 316 baffle may be made of hollow metal sheets which may be coated with an anticorrosion plastic or polyethylene board.

Having described the invention, it will be apparent that modifications may be made thereto without departing from the scope of the invention.

What is claimed is:

1. A sewer and storm water drainage system for a flow of waste water having a general flow direction, the system comprising:

a baffle having a first and second position;

said first position being substantially perpendicular to said general flow direction;

said second position being substantially parallel to said general flow direction;

the baffle having a density less than water to facilitate the movement of the baffle from the first position to the second position and such that the baffle floats on the flow of waste water;

a pivot rod connected to said baffle wherein said baffle moves from said first position to said second position when a hydraulic gradient exceeds the force necessary to move said baffle out of said first position; and a torque limiting device to lock the baffle in the first position, to unlock the baffle at a predetermined hydraulic gradient force such that the baffle moves toward the second position, and to enable the baffle to return to and lock in the first position when the hydraulic gradient falls below the predetermined hydraulic gradient force.

2. The system of claim 1 wherein said pivot rod is held in said first position with the torque limiting device.

3. The system of claim 1, wherein the torque limiting device comprises:

a seat member having a first surface and a second surface, and at least one detent on the first surface, the at least one detent adapted to engage an aperture;

at least one biasing member to maintain the baffle in the first position by biasing the second surface of the seat member such that the at least one detent engages the aperture; and wherein the at least one detent is adapted to disengage from the aperture at the predetermined hydraulic gradient force to enable the baffle to move from the first position toward the second position.

4. The system of claim 3, wherein the at least one biasing member is a spring.

5. The system of claim 1, wherein the weight of the baffle facilitates the baffle moving toward the first position when the hydraulic gradient falls below the predetermined hydraulic gradient force and facilitates the at least one detent to engage the aperture such that the baffle locks in the first position.

6. The system of claim 1, wherein the baffle comprises at least one hollow metal sheet coated with at least one of an anticorrosion plastic layer and a polyethylene board.

7. The system of claim 1, wherein the predetermined hydraulic gradient force is approximately 38,200 gallons per minute (GPM).

8. The system of claim 1, wherein the baffle is adapted to rotate about the pivot rod in a range of approximately two degrees to approximately eighty-eight degrees after the torque limiting device unlocks the baffle.

9. The system of claim 1, wherein the predetermined hydraulic gradient force of the torque limiting device is adjustable such that the baffle can move from the locked first position toward the second position to move away from the flow of waste water.

* * * * *